United States Patent [19]

Cedrone

[11] Patent Number: 4,500,003

[45] Date of Patent: Feb. 19, 1985

[54] AXIAL LEAD TESTER/SORTER

[76] Inventor: Nicholas J. Cedrone, 10 Hawthorne Rd., Wellesley Hills, Mass. 02181

[21] Appl. No.: 380,335

[22] Filed: May 20, 1982

[51] Int. Cl.[3] ..... B07C 5/344

[52] U.S. Cl. ..... 209/573; 209/540; 324/158 F

[58] Field of Search ..... 209/571, 573, 574, 540, 209/907; 324/158 D, 158 F, 158 R

[56] References Cited

U.S. PATENT DOCUMENTS

| | | | |
|---|---|---|---|
| 3,537,580 | 11/1970 | Beroset | 209/573 |
| 3,581,889 | 6/1971 | Abraham et al. | 209/573 |
| 4,136,765 | 1/1979 | Abraham et al. | 198/381 |
| 4,320,339 | 3/1982 | Vancelette | 209/573 |

*Primary Examiner*—Randolph Reese
*Assistant Examiner*—Donald T. Hajec
*Attorney, Agent, or Firm*—Kenway & Jenney

[57] ABSTRACT

A tester/sorter for performing electrical tests on axial lead devices such as diodes at a very high throughput rate carries the devices on the periphery of a rotating wheel. A contactor assembly periodically makes electrical connection with one or more of the axial lead devices. A flying arm assembly mounts the contactor assembly so that it travels through a closed loop path of motion with respect to the wheel. In a first path portion, mechanical controls acting on the flying arm assembly lower the contactor assembly into electrical contact with the leads of the device. Once in electrical connection, there is no relative motion between the contactor assembly and the leads. After the test is completed, the mechanical controls lift the contactor assembly away from the leads and return it to its starting position. This travel is substantially free of mechanical impacts that could produce vibrations and thereby degrade the accuracy of the testing.

9 Claims, 3 Drawing Figures

AXIAL LEAD TESTER/SORTER

BACKGROUND OF THE INVENTION

This invention relates to electrical test equipment and more particularly to such apparatus which is adapted for testing axial lead devices while they are moving from an input bin to an output bin.

At the completion of the manufacturing process, axial lead electrical devices such as diodes and resistors must be tested to assure that their electrical characteristics fall within acceptable ranges. Automatic machines are known for testing and sorting such axial lead electronic components. An example of such a machine is the type 1620 magnetic axial lead sorter, manufactured by Daymarc Corporation of Waltham, Massachusetts. In this machine axial lead devices such as diodes are picked up from an input bin on the periphery of a magnetic carrier wheel. From the carrier wheel the diodes are transferred to an index table where the various electrical tests are performed. The index table is horizontal and moves in a step-wise fashion with a pause to allow the test to be performed at a fixed station. With this arrangement, the machine is capable of testing approximately 14,000 diodes per hour on a continuous basis. Although this machine is reliable and performs the electrical tests at a relatively high throughput rate, still higher throughput rates are desirable to keep up with ever greater production rates.

The Western Electric Company has also used magnetic carrier wheels to transport and test axial lead devices. U.S. Pat. Nos. 3,731,783 and 4,136,765 describe machines which use a magnetic carrier wheel for transport. U.S. Pat. Nos. 3,581,889 to Abraham et al. and 3,537,580 to Beroset et al. describe attempts to use a carrier wheel to both transport and test axial lead devices. The Abraham machine includes a stepping motor to drive the wheel in a step-wise manner. The devices carried on the wheel are tested one at a time at a fixed test station. This system involves a constant acceleration and deceleration of the wheel. The deceleration causes mechanical oscillation resulting in contact noise. Testing therefore must be delayed to allow decay of the oscillation. This decreases the available time for testing and certain tests cannot be performed at a single test station or they are performed at a single test station with diminished accuracy.

The Beroset device also uses a rotating carrier wheel. One or more test devices are mounted for movement in conjunction with the rotation of the wheel. The movement of the test device is controlled by a pawl that engages a ratchet wheel mounted on the carrier wheel, a bias spring and a pair of stops that define the angular limits of travel. The test device does not move radially; rather flexible contacts ride over the outer surface of the wheel during movement of the device. During a test period contact leads of the device rest on the leads of the product being tested without relative motion between them. While the Beroset system appears to avoid certain of the problems of the Abraham system, it also has problems. Each time the test device strikes a stop member, this collision generates a mechanical vibration. This electrical test must therefore wait for the vibration to dissipate. This results in a shortened test period with attendant disadvantages well known in the art.

It is therefore an object of this invention to provide an axial lead sorter/tester which has a two to three times higher throughput rate than previously known machines while maintaining a high degree of test accuracy.

Another object of this invention is to provide an axial lead sorter/tester which operates at an extremely high rate but is generally free of mechanical vibrations that can degrade the accuracy of the testing.

Yet another object of the invention is to provide a high speed test apparatus with a long test period.

It is a further object to provide such a machine which is highly reliable in its operation.

A still further object of this invention is an axial lead tester having a mechanically simple structure.

These and other objects and advantages of the invention will become apparent with reference to the following detailed description.

SUMMARY OF THE INVENTION

The apparatus for handling, testing and sorting axial lead electronic devices disclosed herein includes an input bin that holds a supply of the electronic devices. A rotating carrier wheel is provided which includes means for attracting the axial lead devices from the input bin and carrying them in a predetermined circumferentially spaced array on the periphery of the wheel with the devices aligned with the axis of rotation of the wheel. Structure is also provided for selectively stripping the devices from the wheel at predetermined angular positions of the wheel depending on the results of the test. The wheel rotates at a constant velocity.

At least one contactor assembly is provided to make an electrical connection with at least one of the axial lead devices carried on the wheel. As the axial lead device moves through a test zone intermediate the input bin and the stripping apparatus, the contactor assembly moves through a closed-loop path. The path includes a first path portion generally coincident with the test zone during which the contactor assembly is lowered into electrical contact with the leads and moves so that there is no relative motion between the contactor assembly and the leads of the device carried on the wheel. In a second path portion the contactor assembly lifts from the device and moves in a direction opposite to the direction of rotation of the wheel to a pre-selected reentry point at the beginning of the test zone. In a preferred embodiment the contactor assembly is supported by a flying arm assembly having a pivot arm that pivots at its lower end about a point near, but offset from the axis of rotation of the carrier wheel. The upper end of the pivot arm supports a pivoted four-bar linkage with one "bar", a pivot bar, radially aligned with the axis of rotation of the wheel. The flying arm assembly allows this pivot bar, which directly supports the contactor assembly to move lengthwise along a radius from the center of rotation of the wheel even as the pivot arm rotates. Movement of the flying arm assembly is under the control of a lift cam and a follower cam. On the first path portion, the flying arm assembly is preferably mechanically coupled to a member rotating in unison with the carrier wheel to guarantee a coincident circumferential movement of the contactor assembly and the device or devices being tested. In the preferred form, two contactor assemblies each mounted on an associated flying arm assembly operate out of phase with one another to provide substantially continuous testing of devices carried on the wheel.

BRIEF DESCRIPTION OF THE DRAWING

The invention disclosed herein will be better understood with reference to the following drawing in which.

DESCRIPTION OF THE PREFERRED EMBODIMENT

Figure 1:
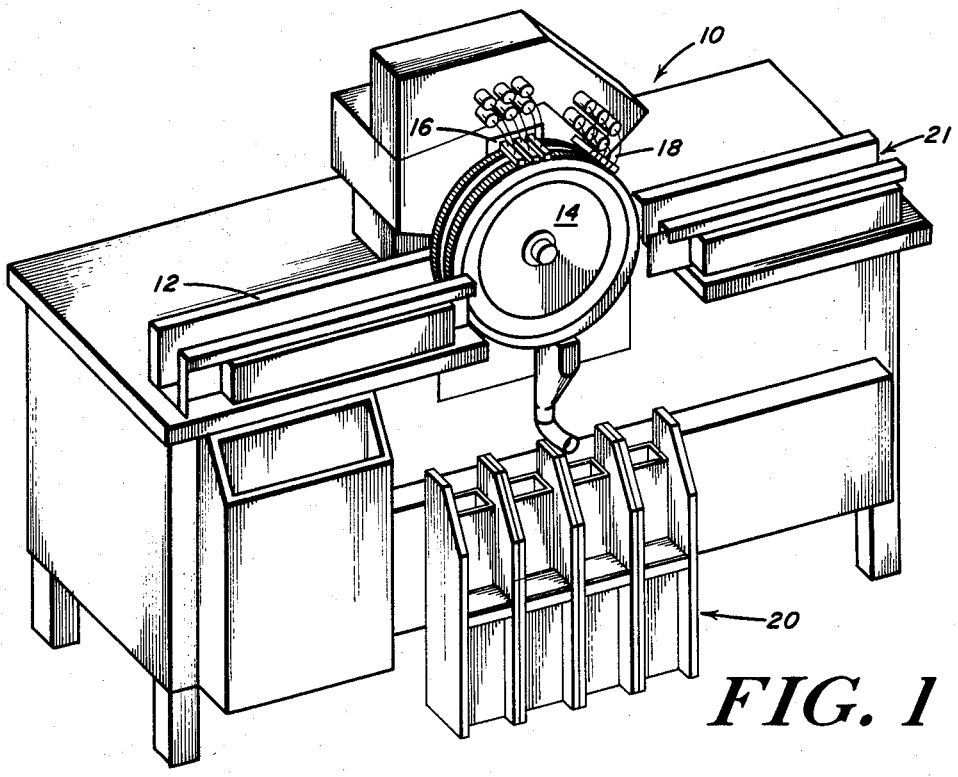
FIG. 1 is a perspective view of the overall axial lead testing apparatus disclosed herein.

With reference to FIG. 1, an axial lead testing apparatus 10 includes an input bin 12 that holds a supply of axial lead devices such as diodes. The bin 12 may for example be a conventional magnetic bin which aligns the devices transversely within the bin 12 and propels them horizontally towards a rotatable carrier wheel 14. The wheel 14 is also of known construction and includes magnets or a vacuum arrangement to attract the devices from the input bin and hold them in a circumferentially spaced array on the periphery of the wheel 14. The leads of each device seat in a set of grooves 14*a*, 14*a* that locate and align the device on the periphery of the wheel. Each device is oriented generally parallel to the axis of rotation of the wheel 14. The grooves 14*a*, 14*a* are structured and sized so that each groove pair holds only one device and the leads project above the outer surface of the wheel 14 slightly to facilitate connection to an electrical test apparatus. The wheel 14 rotates at a constant velocity in a clockwise direction (as shown).

As the axial lead devices move on the periphery of the wheel 14 from the input bin 12, they pass under a first contactor assembly 16 and a second contactor assembly 18. These assemblies 16 and 18 establish electrical connection between the axial lead devices and a test circuit (not shown) of suitable design. This connection is made as the devices move continuously on the carrier wheel 14 through a "test zone" associated with each of the contactor assemblies 16 and 18. After the axial lead devices have been tested, strippers 19 operating in response to the results of the test strip the devices from the carrier wheel 14 and load them into output bins 20 or an output holding bin 21 having a design similar to that of the input bin 12.

Figure 3:
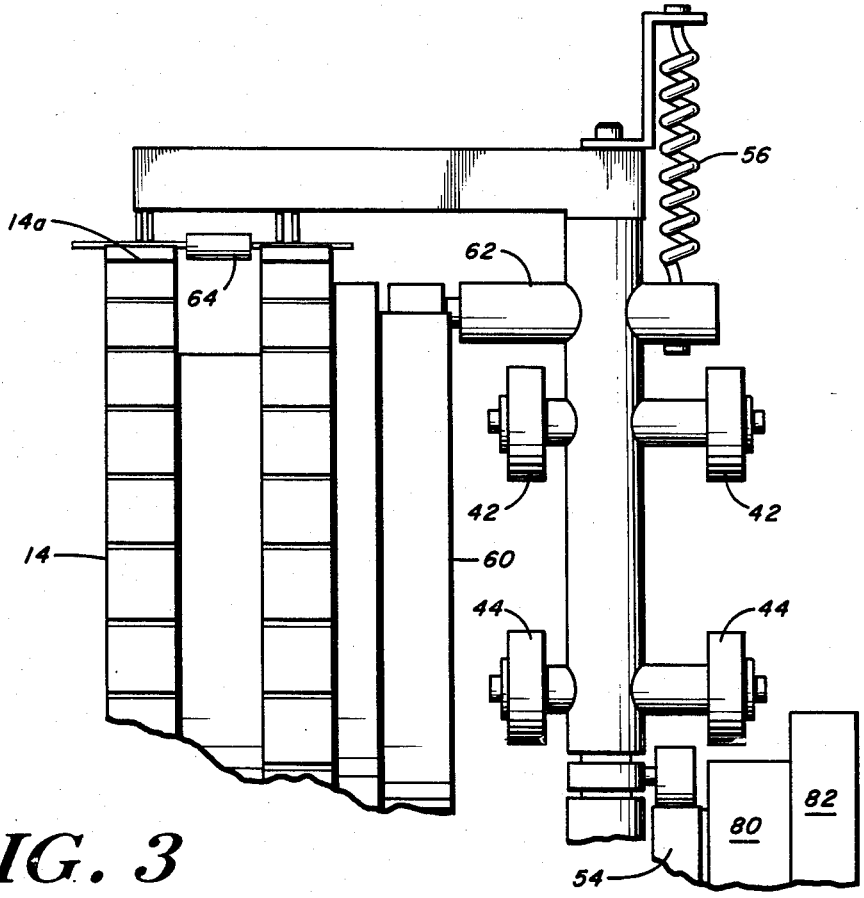
FIG. 3 is a view in side elevation, with portions broken away, of the flying arm assembly and carrier wheel.
Figure 2:
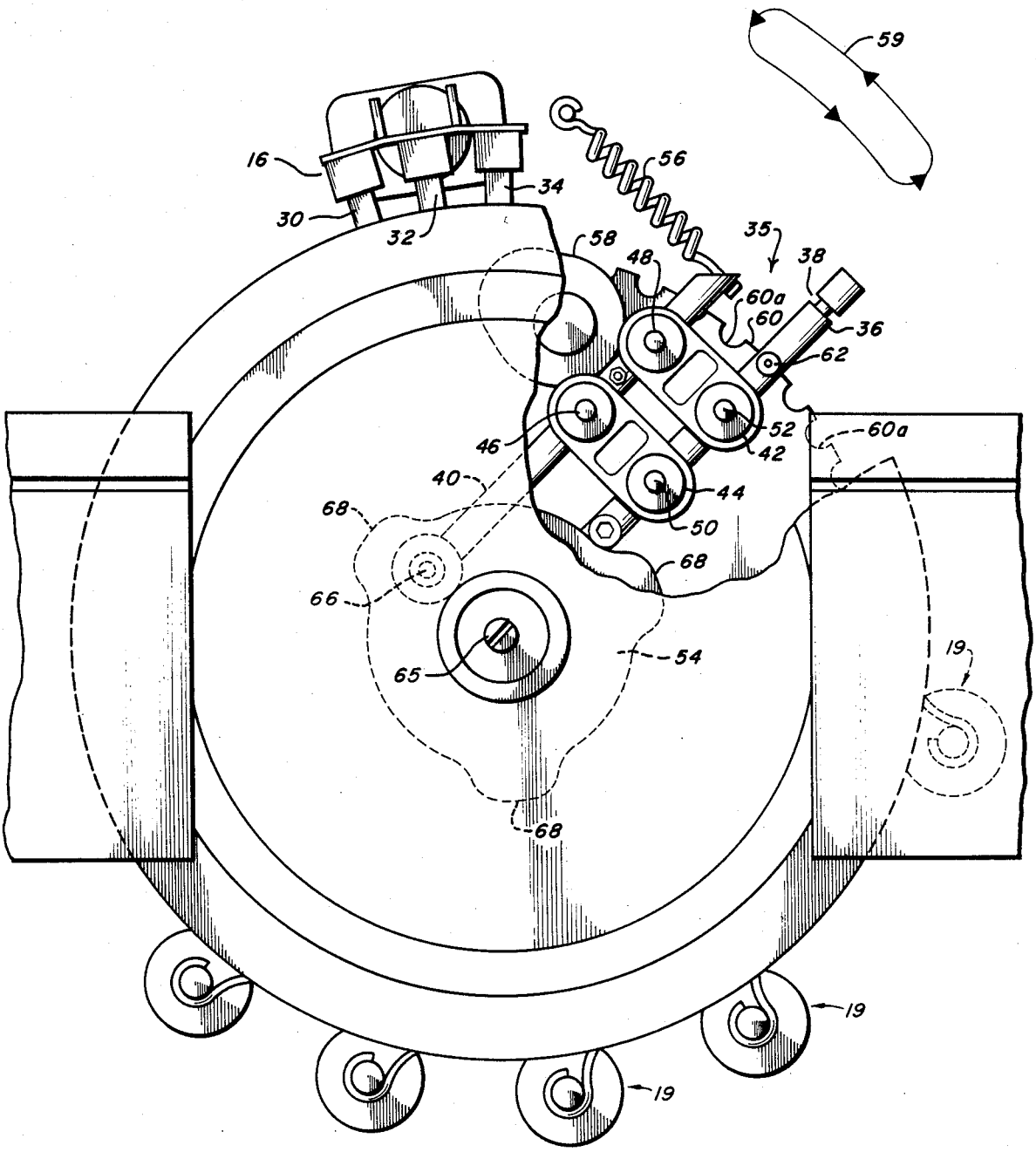
FIG. 2 is a front elevation view, with portions broken away, of the flying arm assembly of the apparatus.

With reference to FIGS. 2 and 3, the contactor assemblies 16, 18 each includes three pairs of electrical contacts 30, 32 and 34, preferably double Kelvin contacts. Each pair simultaneously engages and makes electrical connection with the axial leads of three devices carried on the wheel. Preferably the contact pairs 30, 32 and 34 on each assembly 16 and 18 are spaced to test alternating devices. With two assemblies 16 and 18 as shown, one assembly tests the "even" numbered devices and the other assembly tests the "odd" numbered devices. Also, the assemblies operate out of phase with one another so that they make electrical connection with the devices alternately.

The contactor assemblies 16 and 18 are each supported on a flying arm assembly 35, and more specifically on a flying arm 36 at a location 38 (FIG. 2). The flying arm 36 is coupled to a pivot arm 40 by means of links 42, 42 and 44, 44 and pivot joints 46, 48, 50 and 52 to form a "four-bar linkage". The links 42, 42 and 44, 44 are located on both sides of the pivot and flying arms to provide better mechanical stability.

The lower end of the flying arm 36 is in contact with a lift cam 54. A spring 56 biases the pivot arm 40 against a follower cam 58. Rotation of the cams 54 and 58 in coordination with the configuration of the cams drives the flying arm assembly through a closed loop path 59 of motion during each cycle. A synchronizing wheel 60 is fixed to the carrier wheel and rotates in unison with it. The outer periphery of the wheel 60 has a set of evenly spaced notches 60*a* that each can engage a roller 62 carried on the flying arm 36 and cause the wheel 60 to pivot the entire flying arm assembly in precise coordination with the rotation of the carrier wheel.

As the carrier wheel 14 rotates with an axial lead device 64 (FIG. 3) carried on its periphery, the contacts make a good electrical connection with the leads of the device 64 so that accurate electrical tests can be performed. In order to achieve a high throughput rate, it is necessary to perform the test while the wheel 14 is moving. The contactor assemblies 16 and 18 must therefore be moved from a location spaced away from the devices into contact with them while the carrier wheel 14 is moving. It is also necessary that the contactor assemblies 16, 18 move so that there is no relative motion between the leads of the devices and the contacts during a test period. This condition has proven difficult to achieve. One problem is that the axis of rotation 65 of the carrier wheel is occupied with a drive train 80 (FIG. 3) driven by a motor 82 (FIG. 3). The pivot arm 40 therefore cannot pivot about the center 65. A significant feature of this invention is that the pivot arm 40 is pivoted about an axis 66 which is offset from the axis of rotation 65, however, the contacting assemblies 16 and 18 move as though they were pivoted about the axis 65. It should be noted that the gear train 80 also drives the cams 54 and 58 in precise coordination with the rotation of the wheel 14.

The operation of the apparatus disclosed herein will now be described with reference to FIGS. 2 and 3. As can be seen in FIG. 2, as the cam member 54 rotates, the flying arm 36 alternately moves toward and away from the synchronizing wheel 60 while remaining parallel to the pivot arm 40. When the flying arm 36 is in its lowermost position, the pin 62 rests within a notch of the synchronizing wheel 60. When this occurs, the flying arm 36 is thus constrained to move in synchronism with the carrier wheel 14 so that there will be no relative motion between the flying arm 36 and the carrier wheel 14. This is the "test" portion of the cycle of operation. As the carrier wheel 14 and synchronizing wheel 60 move, the flying arm 36 behaves as though it were pivoted about the axis 65 rather than the axis 66 of the pivot arm 40. While the flying arm 36 moves through the testing zone, the cam member 58 rotates so that the cam member 58 remains a constant, small distance away from the pivot arm 40. When the flying arm 36 reaches the end of the test zone, the cam 54 rotates so that one of its protrusions 68 lifts the arm 36 and the pin 62 from a notch in the synchronizing wheel 60. As the pin 62 disengages, the cam member 58 resists the force of spring 56 and determines the circumferential position of the arm 36. The cam member 58 now rotates so that the pivot arm returns to its initial position. This is the return portion of the cycle of operation. The cycle then begins again by the rotation of cam member 54 so that the flying arm 36 is once again lowered so that its pin 62 engages another notch in the synchronizing wheel 60. In this way, flying arm 36 is repeatedly lowered so that its associated contacting assembly is brought into electrical contact with an axial lead device 64. This cycle of operation repeatedly drives the flying arm 36 and the associated contactor assembly through the closed loop path 59.

Alternating the testing between the two contact assemblies 16 and 18 provides full utilization of the test apparatus 10. The apparatus tests continuously, first with the contactor assembly 16 in the test portion of its cycle and then with the contactor assembly 18 in the test portion of its cycle, except for 2–3 millliseconds required to switch between contact assemblies. When a contactor assembly is in the test position it has a comparatively long test period characterized by no relative motion between the contacts and the device and by a freedom from mechanical vibrations and the associated contact noise. Each assembly is repositioned for a new test period while the other assembly is in a test period.

It is also important that almost all of the test portion of each cycle is available for testing. There is no index time or time when the testing must wait for vibrations to dampen. At a test rate of 36,000 devices per hour the useful test portion can extend for approximately 100 milliseconds, less the aforementioned 2–3 milliseconds for switching. This comparatively long test time allows more accurate tests to be performed while maintaining the extremely high output rate of 36,000 devices per hour.

It is thus seen that the objects of this invention have been achieved in that there has been described testing apparatus permitting high throughput rates owing to testing while the devices continue their movement from an input bin to an output bin. The apparatus described is of simple mechanical construction and highly reliable.

It is to be understood that modifications and variations of the invention disclosed herein will occur to those skilled in the art, and it is intended that all such modifications and variations be included within the scope of the appended claims.

What is claimed is:

1. Apparatus for handling, testing and sorting axial lead electronic devices comprising:

an input bin that holds a supply of said devices, a rotating wheel carrier for the devices that includes means for attracting devices from said input bin and carrying them in a predetermined, circumferentially spaced array on the periphery of said wheel with the devices aligned with the axis of rotation of said wheel, means for selectively stripping said devices from said wheel at at least one predetermined angular position of said wheel, means for rotating said wheel, at least one contactor assembly structured to make an electrical connection to at least one of said axial lead devices carried on said wheel when the device moves through a test zone intermediate said input bin and said stripping means, and mechanical means for mounting and moving said contactor assembly through a closed loop path that includes (i) a first path portion generally coincident with said test zone where said contactor assembly is lowered into electrical connection with said leads and moves so that there is no relative motion between said contactor assembly and said device carried on said wheel and (ii) a second path portion where said contactor assembly is raised from said devices and moves in a direction opposite to the direction of rotation of said wheel to a preselected re-entry point at the beginning of said test zone, said mechanical means including (i) a flying arm assembly having a pivot arm mounted for pivotal movement at a lower end about an axis that is offset a distance from the axis of rotation of said wheel, (ii) a flying arm mounted on said pivot arm for movement along a line which is coincident with a radius of said wheel, and (iii) means for positively mechanically coupling said flying arm assembly to said wheel for said movement along said first path position when said contactor assembly is lowered into electrical connection with said leads, said mechanical means being substantially free of mechanical collisions and vibrations that would detract from the accuracy of said testing.

2. The test apparatus of claim 1 wherein said positive mechanical coupling means comprises a synchronization wheel that rotates in unison with said carrier wheel and a drive pin mounted on said flying arm assembly that engages said synchronization wheel when said contactor assembly is lowered and is clear of said synchronization wheel when said contactor assembly is raised.

3. The test apparatus according to claim 2 wherein said synchronization wheel has a series of equispaced recesses formed on its periphery each structured to receive and hold said drive pin.

4. The test apparatus according to claim 1 wherein said mechanical means further comprises first cam means for lowering and raising said flying arm at the beginning and end of said test zone, respectively, to produce a corresponding lowering and raising of said contactor assembly mounted on said flying arm.

5. The test apparatus according to claim 4 wherein said mechanical means includes second cam means for moving said flying arm assembly and said contactor assembly along said second path portion in a circumferential direction opposite to that of said wheel.

6. The test assembly according to claim 5 wherein said drive means includes a motor and a gear train that rotates said carrier wheel and synchronization wheel in coordination with said second cam means.

7. The test assembly according to claim 4 wherein said drive means includes a motor and a gear train that rotates said carrier wheel and synchronization wheel in coordination with said first cam means.

8. The test assembly of claim 4 wherein said drive means rotates said carrier wheel at a uniform velocity.

9. The test assembly according to claim 1 wherein said flying arm assembly includes at least one link arm that is pivotally mounted at said pivot arm and said flying arm and couples these two arms.

* * * * *